United States Patent [19]

Phlaphongphanich

[11] Patent Number: 4,815,615

[45] Date of Patent: Mar. 28, 1989

[54] INFANT FEEDING SYSTEM

[75] Inventor: Vichai Phlaphongphanich, Samut Sakorn, Thailand

[73] Assignee: Royal Industries (Thailand) Co., Ltd., Bangkok, Thailand

[21] Appl. No.: 135,138

[22] Filed: Dec. 18, 1987

Related U.S. Application Data

[63] Continuation of Ser. No. 921,746, Oct. 22, 1986, abandoned.

[51] Int. Cl.[4] ..... A61J 9/00; A61J 9/08; A61J 11/04; B65D 71/08

[52] U.S. Cl. ..... 215/11.1; 215/11.3; 215/11.6; 206/471; 206/497

[58] Field of Search ..... 215/11.1–11.6; D24/47, 48; 128/359, 36; 220/407; 206/471, 497

[56] References Cited

U.S. PATENT DOCUMENTS

| | | | |
|---|---|---|---|
| 2,133,411 | 10/1938 | Zohe | 215/11.1 |
| 2,624,485 | 1/1953 | Boston | 215/11.3 X |
| 2,628,913 | 2/1953 | Horan | 215/11.3 X |
| 2,876,113 | 3/1959 | Barton | 215/11.3 X |
| 2,885,104 | 5/1959 | Greenspan | 215/11.1 X |
| 3,146,904 | 9/1964 | Hansen et al. | 215/11.1 |
| 3,161,311 | 12/1964 | Boston | 215/11.3 |
| 3,232,467 | 2/1966 | Barton | 215/11.3 |
| 3,273,703 | 9/1966 | Stribley | 215/11.6 X |
| 3,373,864 | 3/1968 | Barton et al. | 215/11.6 X |
| 3,406,853 | 10/1968 | McLeod | 215/11.3 |
| 3,500,831 | 3/1970 | Schaar | 128/252 |
| 3,549,036 | 12/1970 | Ritsi | 215/11.6 |
| 3,664,535 | 5/1972 | Mette | 215/11.1 |
| 3,762,542 | 10/1973 | Grimes | 215/11.3 X |
| 3,777,925 | 12/1973 | Eckholm | 215/11.3 |
| 3,784,039 | 1/1974 | Marco | 215/11.3 |
| 3,800,843 | 4/1974 | Edwards | 215/11.3 X |
| 4,706,827 | 11/1987 | Cabernoch et al. | 215/11.3 |

FOREIGN PATENT DOCUMENTS

| | | | |
|---|---|---|---|
| 1287487 | 2/1962 | France | 215/11.3 |
| 1239600 | 7/1971 | United Kingdom | 215/11.3 |

*Primary Examiner*—Sue A. Weaver
*Attorney, Agent, or Firm*—Blodgett & Blodgett

[57] ABSTRACT

System for feeding infants, consisting of disposable nipples and including flexible milk bags stored in a tubular casing.

2 Claims, 7 Drawing Sheets

FIG. 3
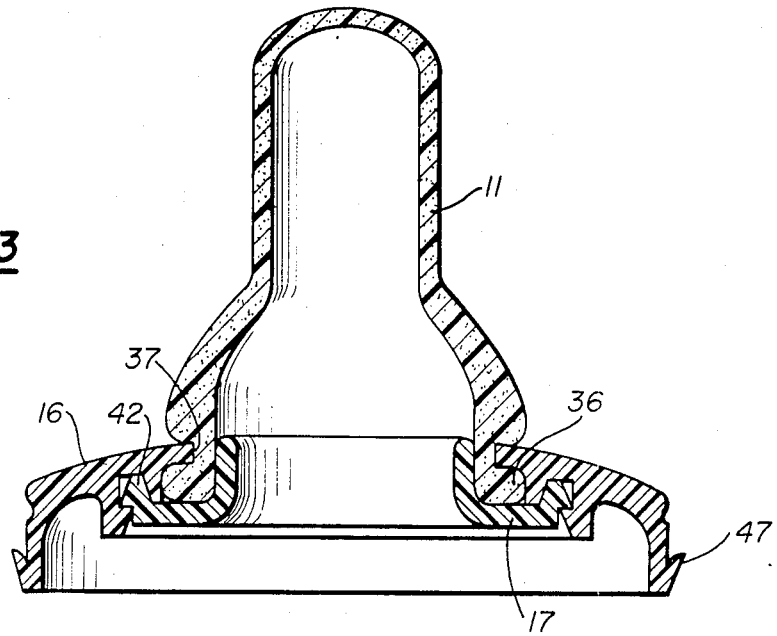
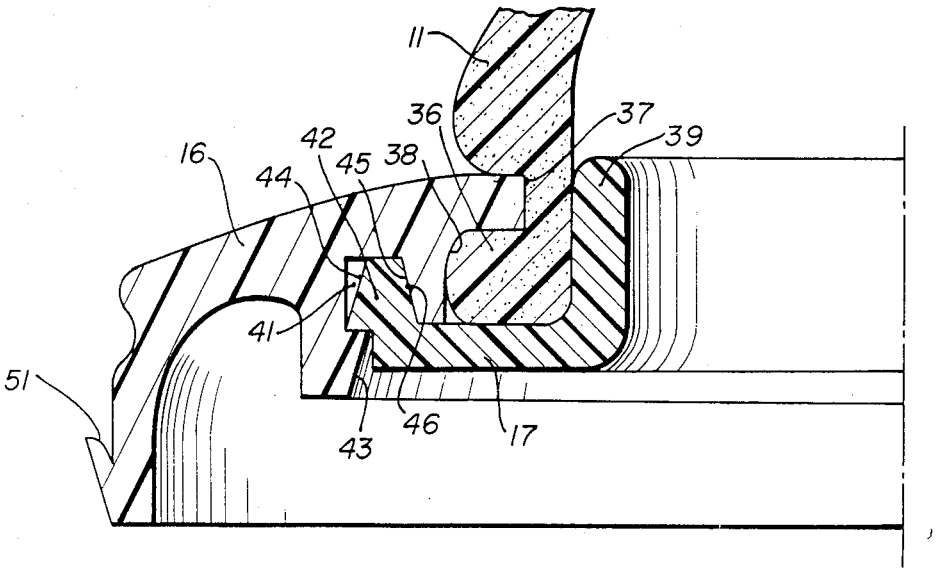
FIG. 4

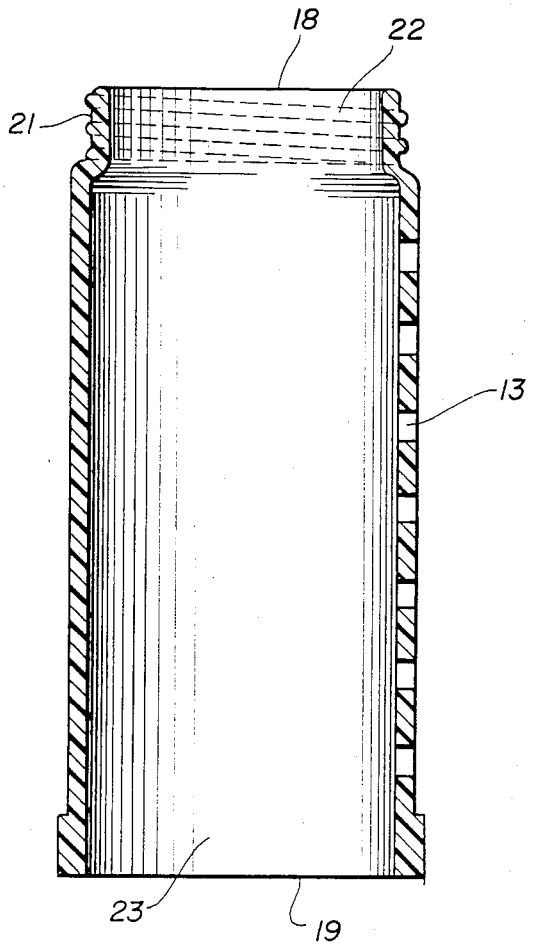
FIG. 5
FIG. 6
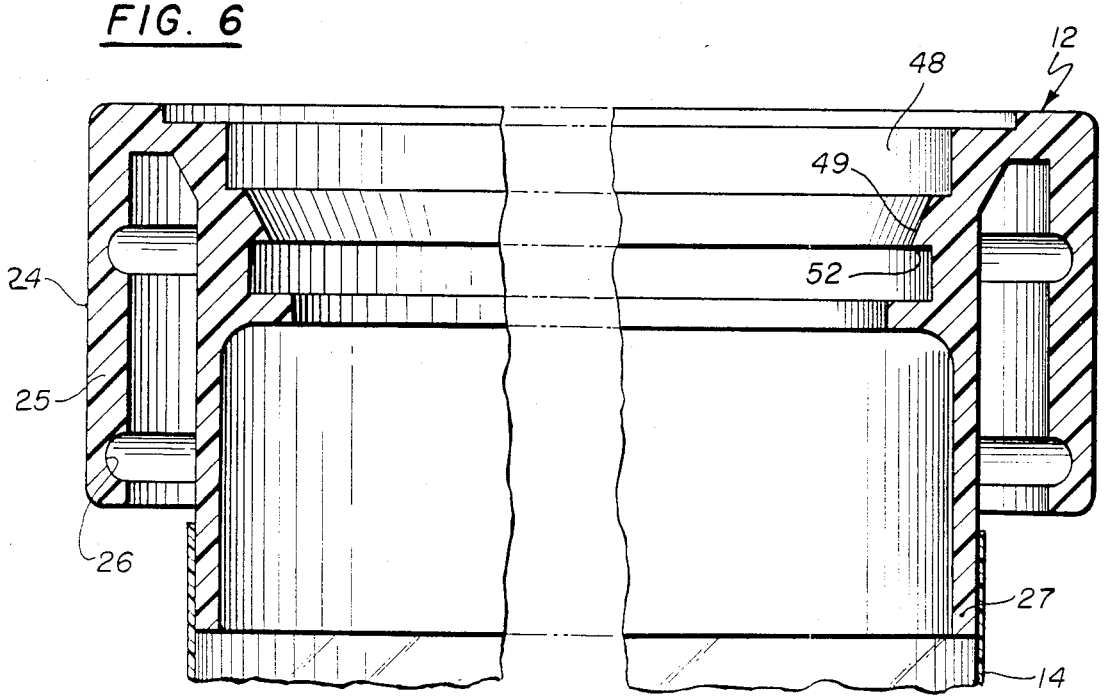

FIG. 7
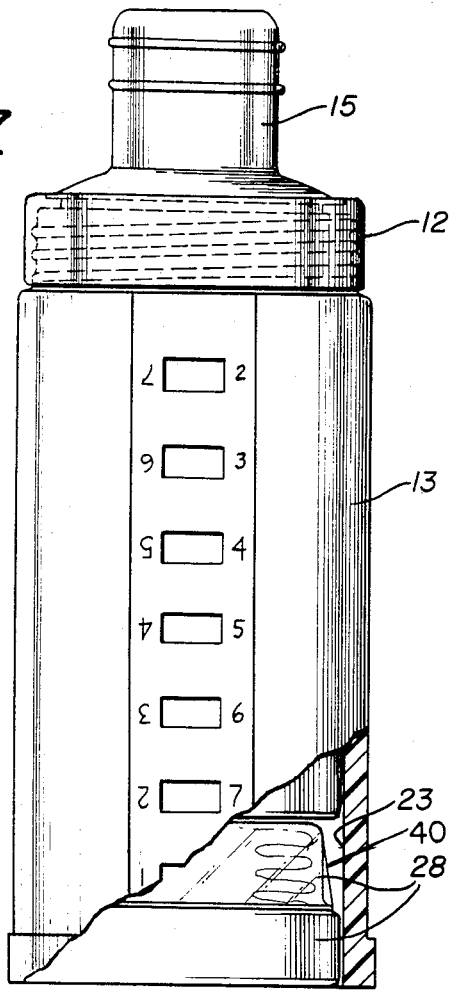
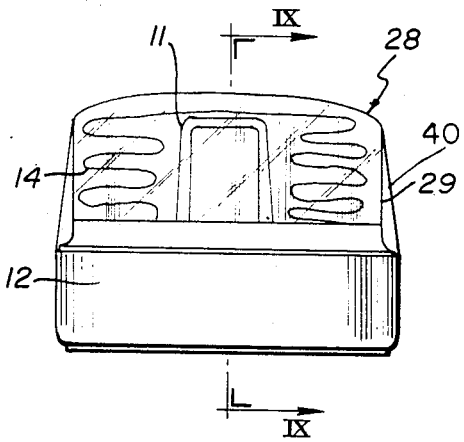
FIG. 8
FIG. 9
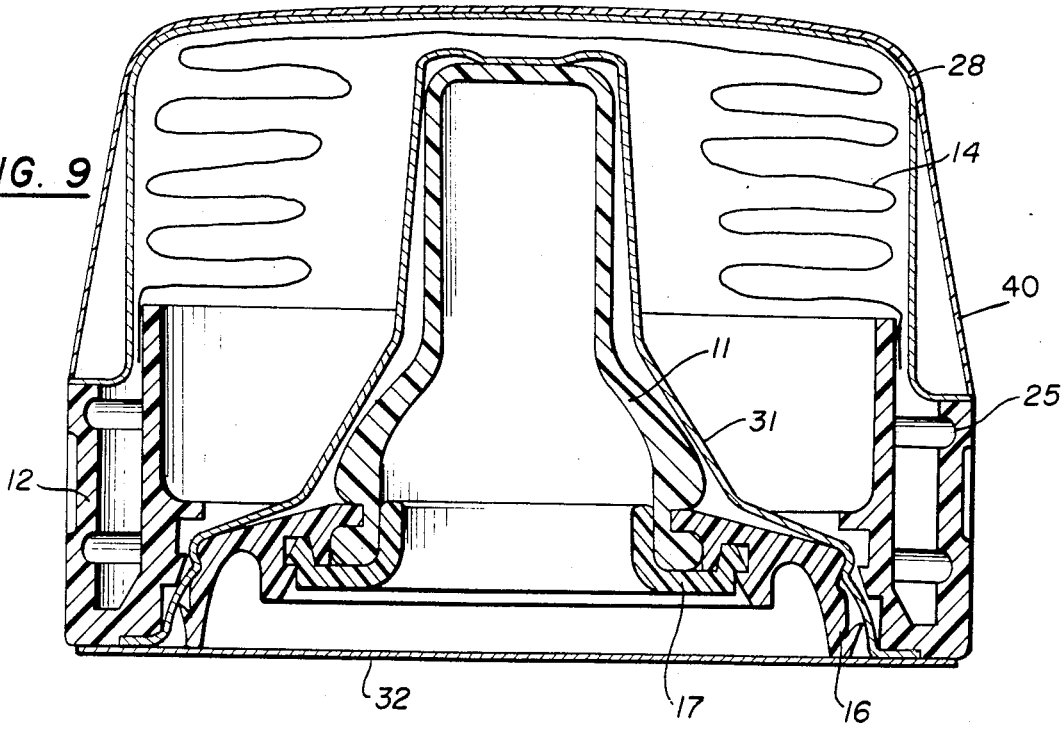

INFANT FEEDING SYSTEM

This is a continuation of co-pending application Ser. No. 921,746, filed on Oct. 22, 1986, now abandoned.

BACKGROUND OF THE INVENTION

It is common practice in feeding infants of a certain range of ages to provide the infant with a container of milk at one end of which is provided a nipple. Although there are very many alternative versions of such feeding methods, a glass or plastic bottle is the common method. The bottle is provided with a cap to which is attached a flexible or elastomer nipple. In such cases, it is important that a means be provided to admit air to the bottle at the same time that the infant is sucking the milk from the nipple. This need for an air vent is not necessary in the case of a flexible bag, because it simply collapses as the milk is removed. The major problem encountered with most of these methods is that of sanitation. In the case of the glass or plastic bottle, it is necessary to sterilize not only the bottle, but also the cap and the nipple that are used with it. Some of the parts deteriorate rapidly when exposed to water of sufficient temperature to kill bacteria. In the case of the flexible milk bag, the many parts that have to be assembled to make up the bottle leads to the possiblity of the bags, nipples and other elements becoming contaminated during storage, sale, or use. The ideal system would involve elements which remain in sterile condition until used and are then disposed of. In this way, the baby is not exposed to any disease-causing bacteria. Unfortunately, those disposable systems that have been developed in the past have suffered from a number of deficiencies. In many cases, they are not capable of being initially sanitized and then remain that way until the baby has used them. Furthermore, in most cases, the equipment has been very expensive and, therefore, it is not economically feasible to dispose of them after use. These and other difficulties experienced with the prior art devices have been obviated in a novel manner by the present invention.

It is, therefore, an outstanding object of the invention to provide an infant feeding system in which the elements are maintained in a sterile condition from the time of manufacture to the time of use.

Another object of this invention is the provision of an infant feeding system in which the parts can be manufactured and assembled cheaply, thus rendering it possible to dispose of the feeding elements immediately after use.

A further object of the present invention is the provision of a feeding system in which the major elements of the apparatus are preassembled in a sterile condition and are not, therefore, contaminated by being assembled at the point of use.

It is another object of the instant invention to provide an infant feeding system in which the elements are assembled in a convenient storage group and enclosed in a wrap that maintains them in sterile condition until use.

A still further object of the invention is the provision of a system for feeding infants in which it is possible to assemble the parts for feeding without contamination from the hands of the assembler.

It is a further object of the invention to provide a system for infant feeding devices in which a large number of disposable feeding devices are compactly packaged for storage and transportation.

It is a still further object of the present invention to provide a system for the storage and sanitary packaging of a substantial number of feeding elements.

Another object of the invention is the provision of infant feeding system which is simple in construction, which can be inexpensively manufactured, and which is capable of use in a situation where sanitary storage is difficult.

With these and other objects in view, as will be apparent to those skilled in the art, the invention resides in the combination of parts set forth in the specification and covered by the claims appended hereto.

SUMMARY OF THE INVENTION

In general, the invention consists of an infant feeding system having a casing of elongated tubular form with upper and lower open ends, the casing having a reduced portion at the upper end and a bore entering the lower end. A first ring is carried on the reduced portion with a milk bag carried on one side inside the casing and with a nipple extending from the other side in normal position. A second ring is carried in the bore of the casing with a milk bag carried on one side and with a nipple carried in the ring in storage position and extending into the bag.

More specifically, a plurality of disposable units are carried in the bore, each unit including a ring, milk bag, and nipple. The ring has a cylindrical outer surface that is slidably carried in the bore and the bag is compressed to occupy a small space. The ring has a tubular skirt with internal threads that mate with external threads on the reduced portion of the casing. The ring also has a tubular portion extending concentrically of and spaced inwardly of the skirt and a milk bag having an open end first tightly around the said tubular portion.

BRIEF DESCRIPTION OF THE DRAWINGS

The character of the invention, however, may be best understood by reference to one of its structural forms, as illustrated by the accompanying drawings, in which:

FIG. 3 is a vertical sectional view of a nipple unit forming part of the invention, taken on the line III—III of FIG. 2, FIG. 4 is an enlarged view of a portion of the nipple unit showing the construction in detail, FIG. 5 is a vertical sectional view of a casing forming part of the invention, taken on the line V—V of FIG. 2, FIG. 6 is a vertical sectional view of the invention taken on the line VI—VI of FIG. 2.

FIG. 7 is a front elevational view with portions broken away of the infant feeding system during shipping and storage, FIG. 8 is a front elevational view of a storage unit forming part of the invention, FIG. 9 is a vertical sectional view of the storage unit taken on the line IX—IX of FIG. 8.

DESCRIPTION OF THE PREFERRED EMBODIMENT

Figure 1:
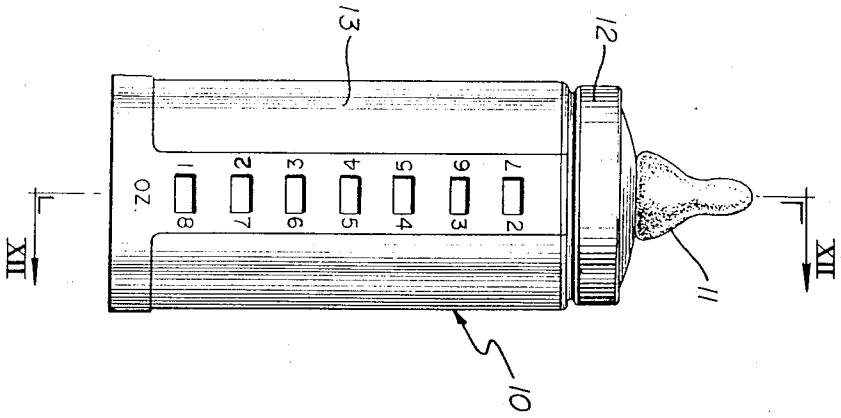
FIG. 1 is a front elevational view of an infant feedng system incorporating the principles of the present invention.

Referring first to FIG. 1, wherein are best shown the general features of the invention, the infant feeding system, indicated generally by the reference numeral 10, is shown as consisting of a nipple 11 which is mounted on a ring 12 which in turn is mounted on one end of a casing 13. This is the condition of the infant feeding system when it is ready for use by the baby with milk carried in the interior.

Figure 2:
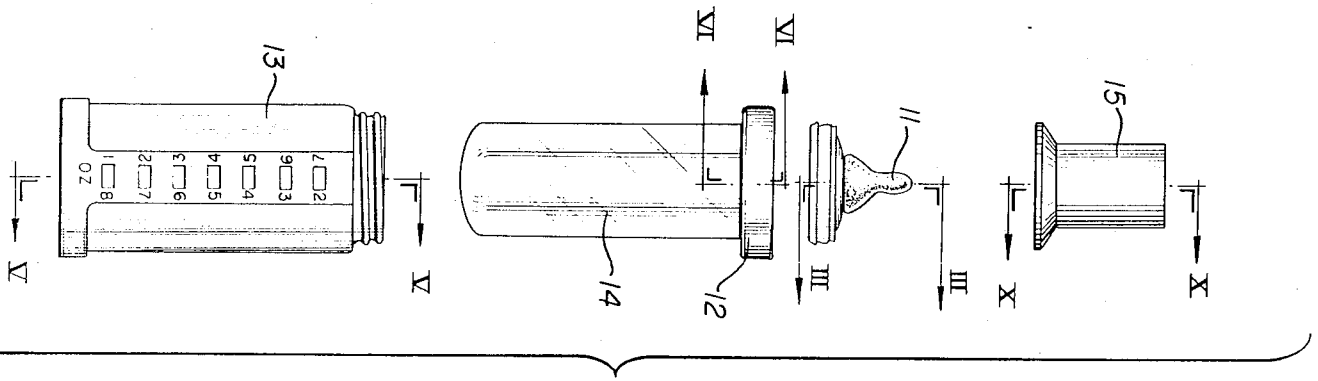
FIG. 2 is an exploded view of the system showing some of the elements in front elevation.

FIG. 2 is an exploded view which shows the elements in the manner in which they are assembled for use. Also shown are additional elements that can not be seen in FIG. 1. Obvious in this view is a milk bag 14 which extends downwardly from the ring 12 and which normally lies inside the casing 13. FIG. 2 also shows a cap 15 which can be used with the system to protect the nipple 1 from contamination before use.

Referring to FIG. 3 and 4, it can be seen that the nipple 11 is formed in the usual way of elastomer, such as latex, and is sssociated with a base 16 and a lockwasher 17.

FIG. 5 shows the construction of the casing 13, particularly the manner in which it is formed as an elongated tube, having an open upper end 18 and an open lower end 19. The casing has an externally threaded reduced portion 21 at its upper end. The reduced portion has a bore 22 which is substantially smaller in diameter than a bore 23 which enters the lower end 19 and extends throughout most of the height of the casing.

Referring to FIG. 6, which shows the details of the ring 12, it can be seen that the ring is of generally disk-like configuration and is provided with an outer circular cylindrical surface 24. The surface is formed on a skirt 25, which skirt is provided with internal threads 26 adapted to mate with the external threads on the reduced portion 21 of the casing 13. The ring also has a tubular portion 27 which extends concentrically of and is spaced inwardly of the skirt 25 and the cylindrical surface 24. The milk bag 14 has an open upper end that fits snugly and is fastened securedly to the outer cylinddrical surface of the tubular portion 27 of the ring. When unfolded, this bag 14 (as is evident in FIG. 2) extends substantially the entire length of the casing 12, resides in the bore 23, and has its lower end located close to the lower end 19 of the casing.

FIG. 7 shows the assembly of the system during shipment and storage before use by the consumer. In this assembly, the casing 13 carries the ring 12 which is attached to the cap 15. In the bore 23 of the casing are located a plurality of storage units 28. The entire assembly of cap 15, ring 12, casing 13, and storage units 28 are completely encapsulated in a clear shrink wrap, not shown.

FIG. 8 shows the exterior of one of the storage units 28; it can be seen that the ring 12 has connected to it a transparent plastic cover 29. The assemblage of the cover and the ring are normally completely wrapped in a thin transparent shrink wrap to render it entirely impervious to bacterial entry. Through the transparent cover can be seen some of the contents, including the nipple 11 and the milk bag 14.

FIG. 9 shows a sectional view through the stoppage unit 28 and the details of that assemblage. First of all, it can be seen that the nipple 11 with its associated base 16 and lockwasher 17 are inserted as a unit inside of the ring 12. Overlying the nipple and locked between the ring 12 and the base 16 is protector 31. The bag 14 (in folded condition) overlies the nipple and the protector 31. Of course, the cover 29 extends from the bottom of the skirt 25 of the ring. It can be seen that the bag 14 is neatly folded in the annular space that surrounds the nipple 11 and its protector 31, the otuer periphery of which is determined by the transparent cover 29. Finally, a disk 32 entirely covers the lower end of the ring 12, while the entire assemblage is provided with a shrink wrap (not shown) that renders the entire unit free of bacteria.

Figure 10:
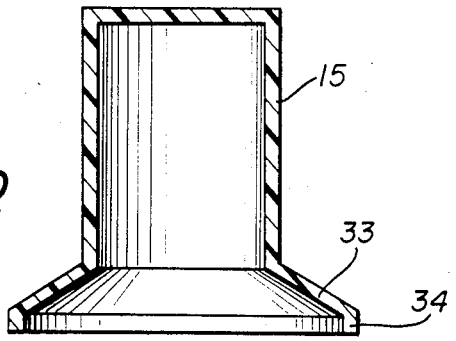
FIG. 10 is a vertical sectional view of a protector forming part of the invention taken on the line X—X of FIG. 2.

FIG. 10 shows the details of the cap 15 which is formed of thin plastic and is provided with an outwardly extending flange 33 the outer of which is provided with an axial ring 34 which is of a size to fit snugly in a bore 48 in the end of the ring 12 when the nipple 11 is in place.

Figure 11:
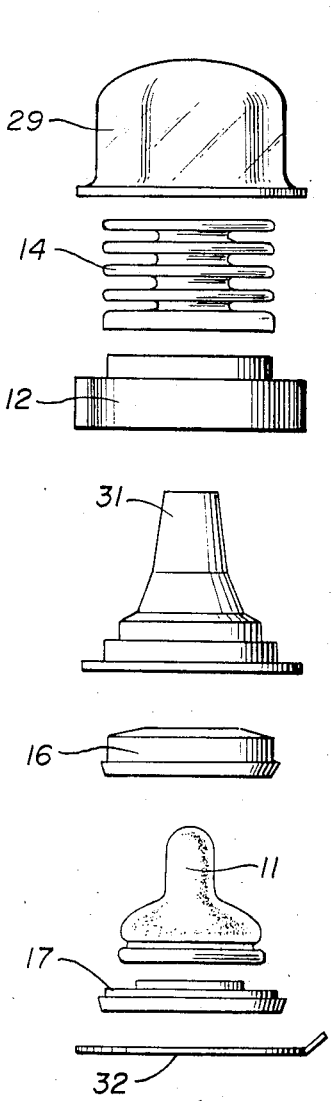
FIG. 11 is an exploded view of the elements making up the storage unit shown in FIG. 9.

FIG. 11 is helpful in understanding the assemblage of the storage unit 28, because it shows in general the order in which the parts are put together. First, the nipple 11 is assembled with its base 16 locked in place by the lockwasher 17. These three elements are combined with the protector 31 and inserted into the ring 12 which has already been provided with the milk bag 14. The disk 32 is then applied to the ring 12, the cover 29 is assembled in place, and the entire assemblage enclosed in a shrink wrap.

Figure 12:
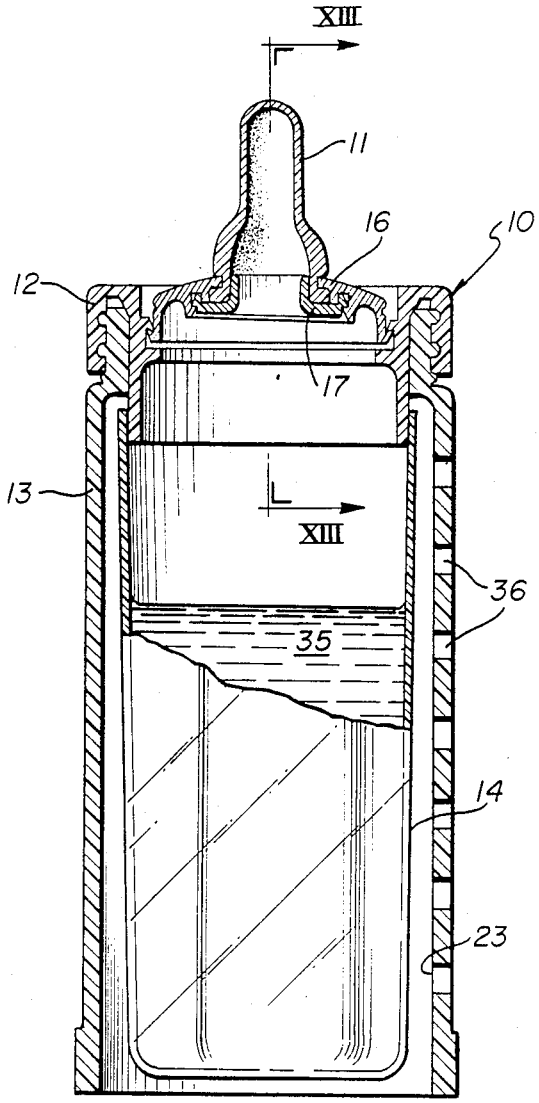
FIG. 12 is a vertical sectional view of the assembly during feeding, taken on the line XIII—XIII of FIG. 1.

FIG. 12 is a sectional view showing the condition of the infant feeding system 10 with the milk 35 in place in the milk bag 14. The ring 12 is mounted at the top of the casing 13. The nipple 11 (mounted on its base 16 and its lockwasher 17) is securely snapped in place in the ring 12, this engagement being tight enough to prevent leakage of the milk 35. It should be noted that the casing 13 is provided with windows 36 by which it is possible to observe the level of milk 35 in the bag 14.

Figure 13:
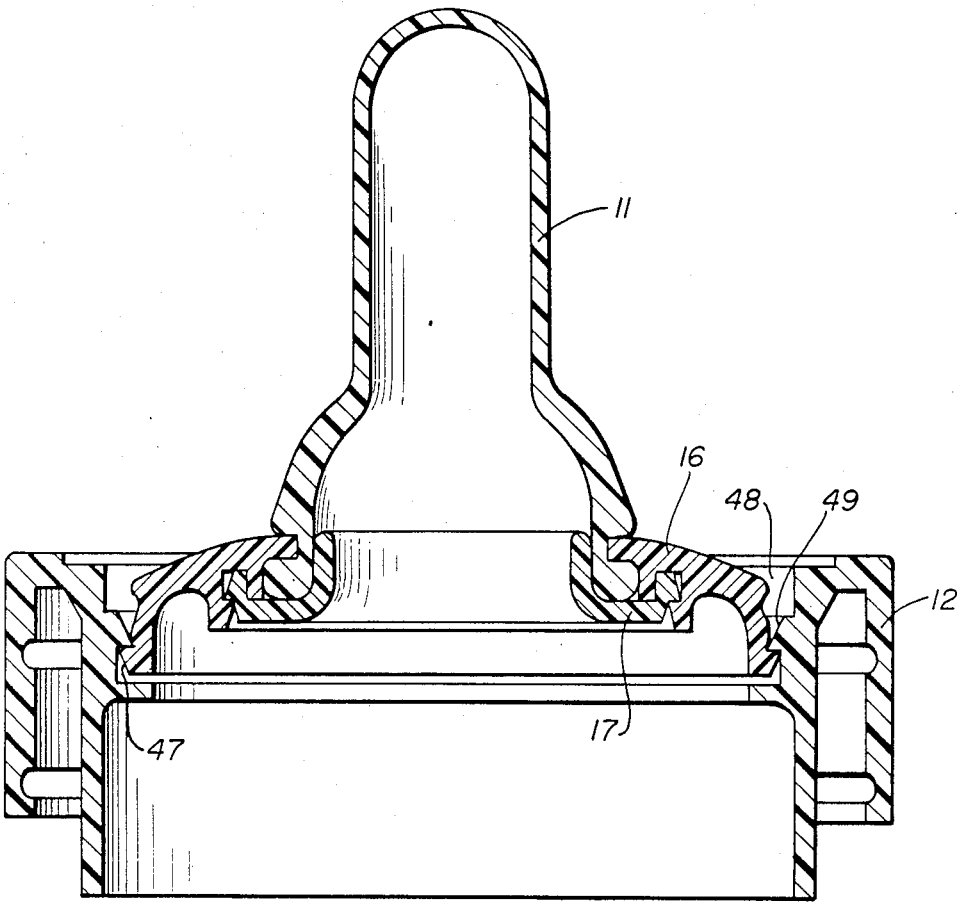
FIG. 13 is an enlarged sectional view of a portion of the apparatus taken on the line XIII—XIII of FIG. 12.

FIG. 13 shows the manner in which the nipple 11 with its base 16 and its lockwasher 17 are held in the ring 12 during use by the infant.

The details of the interconnection between the nipple 11, its base 16, and its lockwasher 17 are shown in FIGS. 3 and 4. The nipple 11 is formed of an elastomer and is provided with an open lower end which terminates in a solid annulus 36. The base 16 is generally circular and has a central bore 37 which is formed with a radial groove 38 that receives the annulus 36. The lockwasher 17 has a central tubular portion 39 that lies in the bore 37 of the base 16 and locks the annulus 36 in the groove 38. The base and washer have a one-way fastening means for locking them in fixed position; this fastening means consists of an axial recess 41 formed in the base 16 and an axial tubular protuberance 42 formed on the lockwasher 17. The recess and the protuberance have matching conical surfaces 43 and 44, respectively, that terminals in radial shelf surfaces that engage in locking position. The recess and the protuberance are each provided with secondary conical surfaces 45 and 46, respectively, that are opposed to the shelf surfaces when the base and washer are in the locking position.

The manner in which the base 16 (which carries the nipple 11 and the lockwasher 17) is snapped in place in the ring 12 can best be seen in FIG. 13. The base 16 has an outer conical surface 47 (see also FIG. 3), while the ring has a bore 48 with a conical surface 49 (see also FIG. 6) that matches and faces the conical surface 47 on the base. These conical surfaces 47 and 49 terminate in radial shelves that are in engagement when the base and ring are in locking position. These radial shelves are shelf 51 on the base 16 (shown in FIG. 4) and the shelf 52 on the ring 12 (shown in FIG. 6).

One of the interesting aspects of the present construction is that the outer surface 24 of the ring 12 has such a diameter that it may fit snugly in the bore 23 of the casing 13. At the same time, the outer diameter of the tubular portion 27 (even with the milk bag 14 in place) can fit into the smaller upper bore 22 of the casing. This is true even under certain circumstances when it is not desireable to engage the threads 26 of the skirt 25 with the threaded reduced portion 21 of the casing. In that case, because the tubular portion 27 extends a considerable distance below the bottom of the skirt 25, the ring can sit on top of the reduced portion without being threaded to it, but will still be stable, because of the presence of the tubular portion 27 extending a substantial distance into the bore 22. In other words, the ring, along with the associated nipple and other equipment that go with it, can fit snugly into the bore 23 for storage. It will fit at the top of the casing either for storage at the point of sale or for use as shown in FIG. 1. This situation prevails even when the unit 28 is completely covered with a shrink wrap 40. The shrink wrap is thin enough and the tolerance such that the surface 24 of the ring 12 can fit in the bore 23 and the surface of the tubular portion 27 can fit in the bore 22.

The operation and advantages of the present invention will now be readily understood in view of the above description. To begin with, all of the elements of the infant feeding system 10 will be completely sterilized at the manufacturing plant and assembled into a package that has the appearance of FIG. 7, except that a complete shrink wrap of this transparent polymer will be provided around the entire assemblage. Lying within the ring 12 and the cap 15 at the top of the package will be an assembly similar to that shown in FIG. 9 but with the nipple 11 and its base 16 and its locking washer 17 placed in reverse position (like the condition shown in FIG. 13), but with the protector 31 and everything else in the same general condition. The nipple is protected by the cap 15 which fits snugly into the bore 48 at the top of the ring. The other units 28 will be stored in the remainder of the bore 23 of the casing that is not occupied by the top element.

In order to place the equipment in condition for use by the baby, the parent, first of all, removes the storage units 28 from the bore 23.. He then removes the shrink wrap and disk 32, allowing the protector 31 with the nipple retained in it to drop into his hand. He then reverses the ring 12 and introduces the base 16 into the top of the ring 12. He does this while holding the protector 31, so that his fingers do not touch either the nipple or its associated equipment. The base is snapped into the ring 12 and protector is then removed and thrown away. Holding onto the ring 12, the parent then removes the cover 29, which allows the bag to drop down. He introduces the milk 35 into the bag and then snaps the base 16 into place in the top of the ring. The ring then can be screwed on the threaded upper reduced portion of the casing. The apparatus is then in the condition shown in FIG. 12 ready for use by the baby.

It should be noted that, at the point of sale and when the assemblage is brought home, the first element lying under the cap 15 is a nipple 11 with its associated protector 31 already in place on the ring. It is necessary, however, to remove the ring and the nipple before use since the cover 29 is still in place. Once that cover and the shrink wrap are removed, the elements are ready for use in the same way. The nipple, of course, with its protector 31 has to be removed in order to insert milk into the milk bag 14. Before the first unit (mounted at the top of the casing) is used, the storage units 28 must be removed from the casing and carried in a convenient bag or the like. Since each storage unit is individually shrink wrapped, there is no danger of contamination. Normally, the assembly of the units shown in FIGS. 3 and 4, i.e., the nipple 11, the base 16, and the lockwasher 17, takes place in the factory under ideal sanitary conditions. Furthermore, this unit is incorporated in the ring 12 with the bag 14 and the cover 29 in the manner shown in FIG. 9. After the cap 15 has been snapped in place (in the bore 48 of the ring 12), the entire assemblage, including the casing 13, the ring 12, and the cap 15, is shrink wrapped once more and this shrink wrap is not removed until the parent takes the assemblage home.

After the baby is through drinking the milk 35 from the milk bag 14 (of the unit, as shown in FIG. 12), the ring 12 is unscrewed from the top of the casing 13 and the assemblage is thrown away. The nipple 11 and its associated equipment is, therefore, disposed of along with the empty bag 14. These units are never used again. When the infant is to be fed once more, the same casing, of course, is used with the remainder of the units 28 to provide separate feedings.

It can be seen, then, that by use of the present system, it is possible to provide inexpensive disposable feeding equipment that is maintained in an entirely santiary condition, since human hands do not touch the critical portions of the equipment. The parent may handle the outside of the ring 12 and the outside of the casing 13, but his manipulation of the nipple 11 and its associated base 16 and lockwasher 17 takes place by pinching the protector 31; the protector is then thrown away once the nipple is in place on the ring. The release of the bag 14 takes place by removing the cover 29 and it is not ever necessary to touch the inside of the bag. The milk is introduced into the bag through the bore 48 in the ring, but the interior of the bag and the interior of the ring are never touched by human hands after sterilization in the manufacturing plant. The materials from which the equipment is made lend themself to being formed by the inexpensive injection moulding methods and these are materials that can be relatively inexpensive. The use of the nipple 11 with an annular 36 that locks in the base 16 means that a minimum amount of latex or silicone is used in the nipple. Since these materials are the most expensive ot the materials, maintaining their use at a minimum in ths way is a desireable feature in making the equipment disposable. Furthermore, since shipment from the manufacturing plant to the point of sale is an expensive part of the pricing of any article, the fact that a great many of feeding units 28 are storable in the casing when it is shipped is a feature that is desireable. In other words, very little vacant space is being shipped, compared with the conventional milk bottle, which is shipped in an empty condition and occupies a great deal of space for its weight.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Infant feeding system, comprising:

(a) a casing in the form of a tube having upper and lower open ends, the tube having an externally threaded reduced portion at the upper end, the reduced portion having a bore that is substantially smaller than the bore in the remainder of the tube, (b) a ring having a tubular skirt with internal threads that mate with the external threads of the casing, the ring having a tubular portion extending concentrically of and spaced inwardly of the skirt, and (c) a milk bag having an open end fitting tightly around the said tubular portion and extending downwardly within the casing through substantially its entire length, wherein a nipple unit is provided to engage the ring in liquid-tight relationship.

2. Infant feeding system, comprising:

(a) a casing in the form of an elongated tube having upper and lower ends, the tube defining a bore, and (b) a plurality of disposable units carried in the bore, each unit including a ring, milk bag, and nipple, wherein the ring has a cylindrical outer surface that is slidably carried in the bore and wherein the bag is compressed to occupy a small surface, wherein the casing has an externally threaded reduced portion at one end, and wherein the ring has an internally threaded skirt defining the said cylindrical surface, which skirt can be threaded on the said reduced portion of the casing.

* * * * *